United States Patent [19]

Couture

[11] Patent Number: 4,615,549

[45] Date of Patent: Oct. 7, 1986

[54] DUAL BACKSET LATCH

[75] Inventor: Jeffrey B. Couture, Coronado, Calif.

[73] Assignee: Schlage Lock Company, San Francisco, Calif.

[21] Appl. No.: 639,715

[22] Filed: Aug. 13, 1984

[51] Int. Cl.[4] ..... E05C 1/16

[52] U.S. Cl. ..... 292/169.21; 292/337; 292/1

[58] Field of Search ..... 292/169.21, 169.22, 292/169.23, 337, 1, 172, DIG. 60

[56] References Cited

U.S. PATENT DOCUMENTS 3,020,073 2/1962 Williams ..... 292/169.21

4,427,224 1/1984 Bergen ..... 292/169.23

*Primary Examiner*—Richard E. Moore

*Attorney, Agent, or Firm*—Walter C. Vliet

[57] ABSTRACT

The latch bolt assembly of this invention features a novel cam activating assembly which permits election of one of two door knob spindle backsets which are in standard usage without the need for substituting different operating assemblies or reversing door knob or spindle components. The cam activating assembly features two intersecting rotatably mounted cams which operate about two separate and parallel axes which are the centers of the two spindle backset in common industry usage and further the two cams form a common intersecting aperture for accepting the door knob spindle in one of the two predetermined backset positions. Each cam is capable of independently operating the latchbolt in either direction of rotation through radially extending cam ears which coact with the latch operating plate to convert the rotary motion of the cams to the reciprocating motion required to retract the bolt.

11 Claims, 12 Drawing Figures

FIG. 1
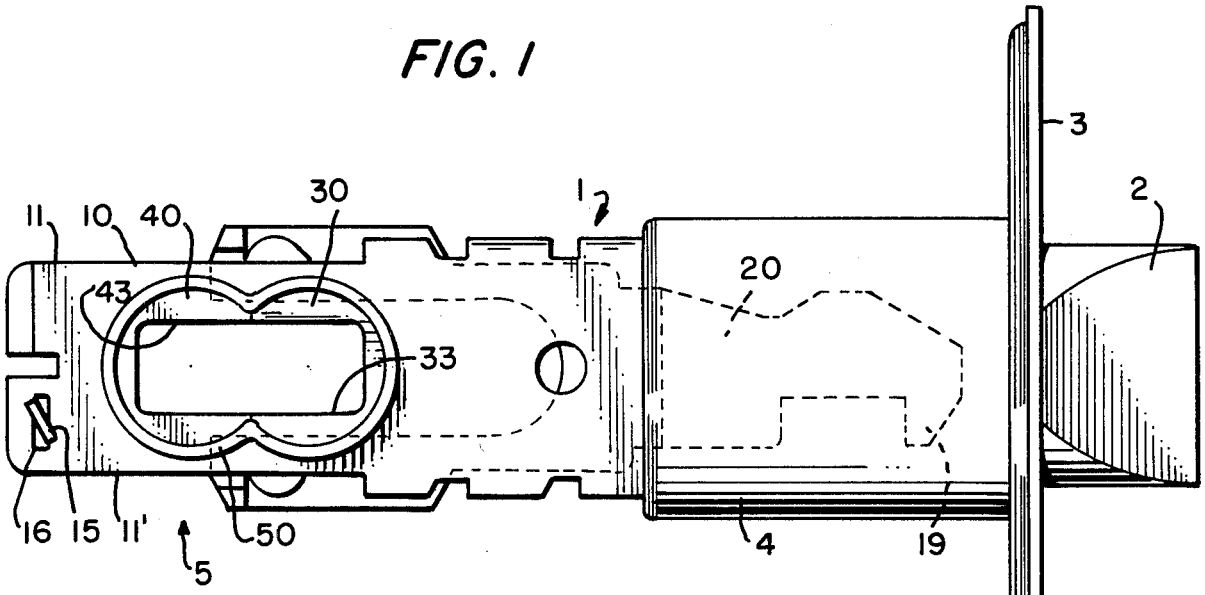
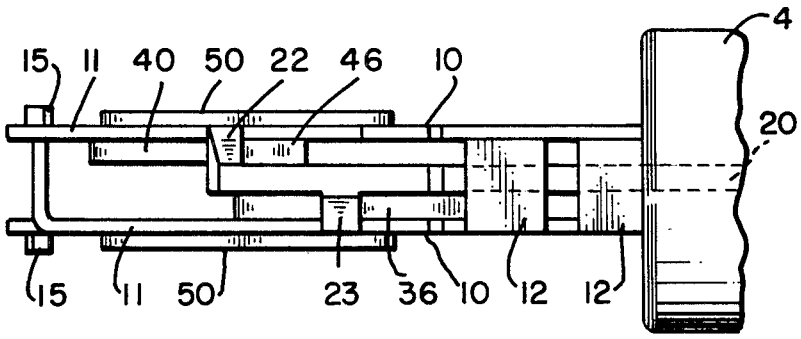
FIG. 2
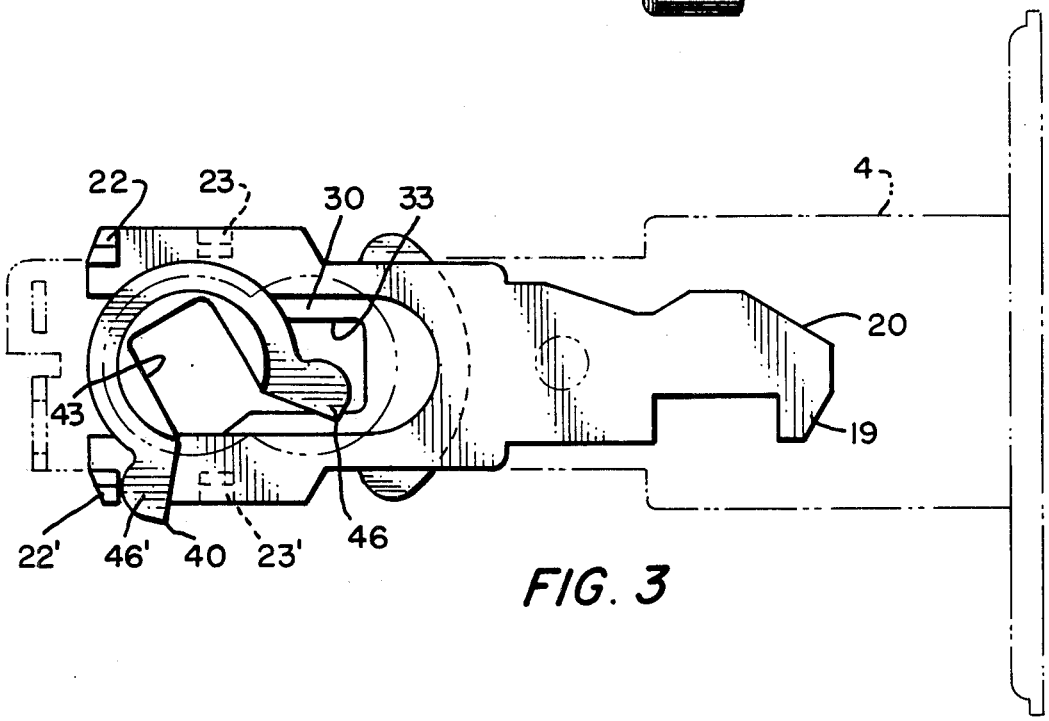
FIG. 3

DUAL BACKSET LATCH

BACKGROUND OF THE INVENTION

In conventional usage in door mounted latch construction the so called backset measurement is the distance from the edge of the door in which the latch bolt is mounted to the transverse axis about which the latch operator, usually a spindle, rotates for extending and retracting the bolt. Backset is measured perpendicularly from the door edge. Backset has for the most part have been standardized by the industry. Two prevailing measurements for backset are 2 and $\frac{3}{8}$ inches and 2 and $\frac{3}{4}$ inches. In the past, most manufacturers of latch constructions have satisfied the demand for the two alternative backset positions by producing and marketing two different and distinctive models of many of the latch constructions. There is a distinct need in the industry for a latch construction which provides the alternate backset selection without the need for substituting parts and/or requiring disassembling the latch mechanism or the use of special shaped spindles. Due to the number of non-expert installers in the field, it is necessary that the selection of backset be simple, reliable and easy-to-accomplish without the need for substitute or complicated assembly and reassembly of interconnected parts.

OBJECTS AND SUMMARY OF THE PRESENT INVENTION

It is therefore an object of this invention to provide a latch bolt assembly of the type for door mounting and the like having integrated therein a unique backset adjustment feature which permits simple selection of the appropriate mounting backset between at least two dimensions.

These and other objects are obtained in a latch construction for mounting in doors and the like of the general type having a bolt longitudinally reciprocating in a door mounted casing between a forward extended position projecting from a door edge and a rearward retracted position substantially fully within the door edge, latch operating means in the casing having a longitudinally forward end operably connected to the bolt and longitudinally rearward end operably connected to an actuation means, the actuating means being rotatable about a transverse axis to displace the operating means to reciprocate the bolt, the longitudinal distance between the door edge and the transverse axis of the rotating means constituting backset, the improvement comprising plural intersecting cam means operable about parallel but offset plural transverse axises for connecting the actuating means to the operating means and converting the rotary action of the actuating means to the reciprocating action of the operating means and thereby reciprocating the bolt.

DESCRIPTION OF THE DRAWINGS

FIG. 1 is a side elevation view of a latch bolt assembly incorporating a preferred embodiment of the backset adjustment features of the present invention. The latch bolt assembly being shown in bolt extended position with the latch operating plate shown in hidden outline.

FIG. 2 is a partial bottom view of the latch bolt assembly.

FIG. 3 is an exposed elevation of the operating cams and latch operating plate of the present invention with the latch bolt assembly in the retracted position as operated by the rearmost cam.

DESCRIPTION OF THE PREFERRED EMBODIMENT

Figure 7:
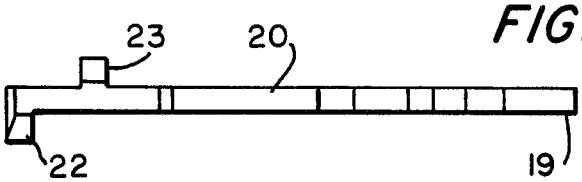
FIG. 7 is a plan view showing the details of the latch operating plate.
Figure 11:
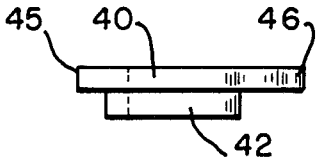
FIG. 11 is a plan view showing the details of the rear cam.
Figure 8:
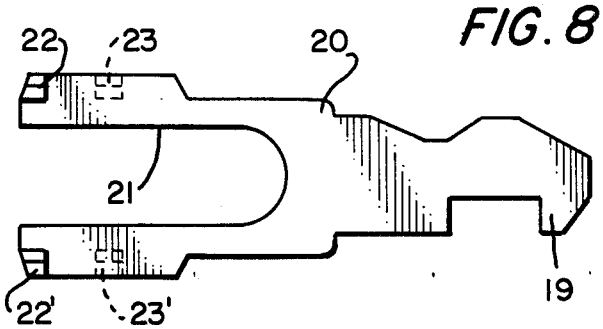
FIG. 8 is a side elevation showing the latch operating plate.

Referring to FIG. 1 a latch bolt assembly is generally shown as indicated by reference numeral 1. Latch bolt assemblies of this general type are known in the industry and comprise a generally cylindrical bolt housing which is inserted into a bore in the edge of the door and secured there by means of a face plate 3. Extending axially from the bolt housing 4 is a latch bolt 2, shown in FIG. 1, projecting to the right of face plate 3. The bolt 2 is mounted for reciprocating motion in the bolt housing. A latch operating plate 20 is operably connected to the bolt 2 by means of a latch hook 19. Details of the latch operating plate are best seen in FIGS. 7 and 8 and are more fully described later.

Shown to the left of the bolt housing and attached thereto is the latch works housing 5 which is formed of a two-piece bent plate. Each half of the housing shell 10 which is top to bottom mating contains an intersecting cam guide 50 which is in the form of a flanged figure eight perforation. Disposed for rotation within the intersecting cam guide are a rear cam 40 and forward cam 30. Rotation of either the rear cam 40 or the forward cam 30 results in lineal translation of the latch operating plate along the axis of the latch operating assembly whereby the bolt is retracted. Rotation of either cam in either direction from the neutral position shown in FIG. 1 results in the retraction of bolt 2.

FIG. 3 shows the retraction of the bolt by rotation of the rear cam 40 in a clockwise direction.

Figure 4:
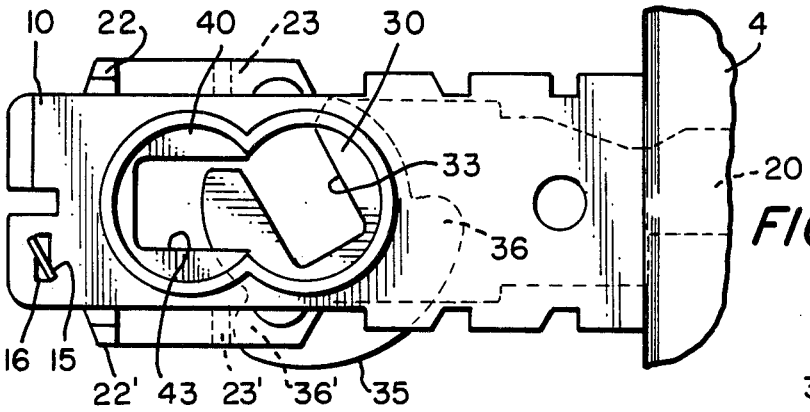
FIG. 4 is a side elevation which is partially sectioned to display the latch operating plate in the bolt retracted position as operated by the forward cam.
Figure 9:
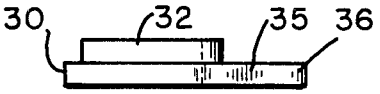
FIG. 9 is a plan view showing details of the forward cam.
Figure 10:
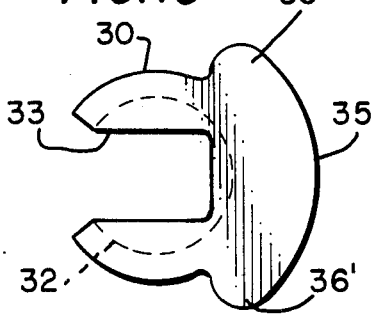
FIG. 10 is a side elevation view showing the details of the forward cam.
Figure 12:
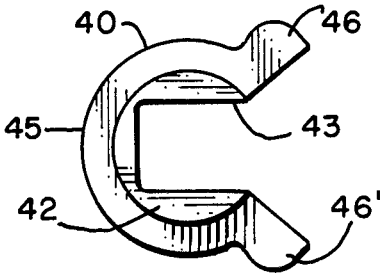
FIG. 12 is a side elevation showing details of the rear cam.

FIG. 4 shows retraction of the bolt by rotation of the forward cam 30 in a clockwise direction. It should be appreciated by one skilled in the art that a square door knob spindle may be inserted in either of the forward cam 30 or rear cam 40 for rotation thereof. Each cam is provided with a rectangular spindle slot 33 & 43 (best seen in FIGS. 10 and 12) to accept a square spindle. It should be understood that other spindle shapes are possible and the spindle slot would, therefore, be shaped to accomodate such spindle cross section.

Figure 5:
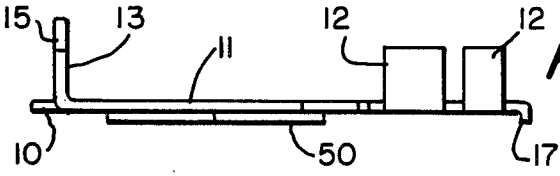
FIG. 5 is a plan view showing the details of the latch operator housing shell.
Figure 6:
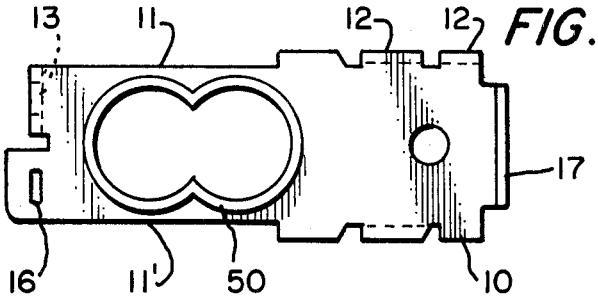
FIG. 6 is a side elevation showing the details of the latch operator housing shell.

Referring now to FIGS. 5 through 12 for details of construction, FIGS. 5 and 6 show effectively a plan view and elevation view of the housing shell 10. The housing shell 10 is assembled to the bolt housings 4 by means of a lip 17 shown on each half of the shell. The housing shell consists of two housing halves shown in FIGS. 5 and 6 which are assembled top to bottom. The housing shell is maintained in its spaced apart relationship by means of tabs 12 and 13 which on assembly form a partial top and bottom for the housing assembly. The rear or left hand edge is assembled by means of rear tab 13 which has an assembly bent tab 15 which inserts in the perforations 16 on the opposite half of the housing shell and is twisted as shown in FIGS. 1 and 4 to retain the housing together. The forward lip 17 which is inserted in the bolt housing 4 prior to assembly maintains the forward edge of the housing shell 10 in spaced relationship thereby forming a generally rectangular box which contains the latch operating works. Disposed in the intersecting cam guide 50 are a forward cam 30 (best seen in FIGS. 9 and 10 in detail and FIGS. 3 and 4 in assembly). The forward cam 30 has a housing bearing 32 which cooperates with one side of the intersecting cam guide 50 in the works housing 5. The circular form of the housing bearing 32 cooperates with one half of the FIG. 8 intersecting cam guide 50. Formed on the forward cam 30 is a latch throw cam 35 having cam surfaces or ears 36 and 36' formed thereon for interaction with the latch operating plate. The rear cam 40 is similarly constructed except its spindle slot 43 is oppositely opening and intersects the throw cam 45 forming its cam surfaces or ears 46, 46'. Rear cam 40 is also provided with a housing bearing 42 for purposes already described for the forward cam 30. Tabs 22, 22', 23 and 23' are used to guide operating plate 20 along housing shell surface 11 and 11' during reciprocal motion of the latch operating plate.

It should be appreciated that the forward cam and the rear cam are disposed on opposite sides of the latch operating plate and coact with the intersecting cam guide 50 on each respective side of the housing shell. Latch operating plate 20 is provided with a pair of rear latch boss 22 and 22' and a pair of front latch boss 23 and 23' which coact with the rear latch throw cam ears 46 and 46' and the forward cam ears 36 and 36' respectively. It should be appreciated by referring to FIG. 3 that clockwise rotation of the rear cam 40 will cause the cam ear 46' to coact with the rear latch boss 22' to thereby displace the latch operating plate to the left as shown in FIG. 3.

It should also be appreciated that rotating of the rear cam in the counter clockwise direction (not shown) will cause cam ear 46 to coact with rear latch boss 22 likewise displacing the latch operating plate 20 to the left as shown in FIG. 3 and thereby retracting the bolt. Similar operation is shown in FIG. 4 for the forward cam 30 coacting latch ear 36' with the front latch boss 23' to thereby retract the bolt. In typical construction the latch bolt is spring loaded to its extended position to the right as shown in FIG. 1.

As previously stated, rotation of both the front and rear cams are accomplished by the door knob spindle which is inserted in the spindle slot 33 or spindle slot 43 depending on the backset selected. For purposes of the preferred embodiment, the backset of the forward cam would be under industry standard 2 and $\frac{1}{8}$ inches and for the rear cam 2 and $\frac{3}{4}$ inches although any suitable backset dimensions may be used. The simple and unique construction of the present bolt assembly provides an effective and foolproof means for making provision for the two standards of backsets common in the industry. Further assembly of the lock is identical for each backset and the instructions for assembly can be made much simpler.

Having described my invention in terms of a preferred embodiment, numerous modifications will now be apparent to one skilled in the art and I do not wish to be limited in the scope of my invention except as claimed.

I claim:

1. In a latch construction for mounting in doors and the like of the general type having a bolt longitudinally reciprocating in a door mounted housing between a forward extended position projecting from a door edge and a rearward retracted position substantially fully within the door edge, latch operating means in said housing having a longitudinally forward end operably connected to said bolt and longitudinally rearward end operably connected to an actuation means, said actuating means being rotatable about a transverse axis to displace said operating means to reciprocate said bolt, the longitudinal distance between the door edge and said transverse axis of said actuating means constituting backset, the improvement comprising:

plural mutually intersecting cam means within said housing interposed between said actuation means and said latch operating means and operable in rotation within said housing about parallel but offset transverse axes for alternatively connecting said actuating means with different backset to said operating means and for converting the rotary action of said actuating means to the reciprocating action of said operating means and thereby reciprocate said bolt.

2. The latch construction according to claim 1 wherein:

each of said intersecting cam means comprises a semi-circular disc having opposed protruding cam surfaces.

3. The latch construction according to claim 2 wherein:

each of said intersecting cam means further comprises a disc having a spindle slot extending through one edge of said disc.

4. The latch construction according to claim 2 wherein:

each of said intersecting cam means further comprises a disc having a semi-circular housing bearing.

5. The latch construction according to claim 4 wherein:

said semi-circular housing bearing is provided with a spindle slot corresponding to a spindle slot in each said cam means.

6. The latch construction according to claim 5 wherein:

said housing bearing cooperates with a housing guide on the side of said housing to permit rotation of said cam means in said housing.

7. The latch construction according to claim 6 wherein:

said housing guide comprises an intersecting FIG. 8 cam guide.

8. The latch construction according to claim 3 wherein said intersecting cam means comprises:

a first forward cam means having opposed first protruding cam surfaces disposed towards one forward side and a first spindle slot disposed toward one rear side;

a second rear cam means having opposed second protruding cam surfaces disposed towards one forward side;

a second spindle slot intersecting said second cam surface; and wherein said first spindle slot on said forward cam intersects and forms an offset continuation of said second spindle slot on said second rear cam.

9. The latch construction according to claim 8 wherein:

said protruding cam surfaces on said forward cam means and said protruding surfaces on said rear cam means cooperate with a plurality of latch bosses formed on said latch operating means whereby rotation of either cam means in either direction retracts said latch operating means.

10. The latch construction according to claim 9 wherein:

said plurality of latch bosses also form guide means for guiding said latch operating means in reciprocating linear translation on said housing.

11. In a latch construction for mounting in doors and the like of the general type having a bolt longitudinally reciprocating in a door mounted housing between a forward extended position projecting from a door edge and a rearward retracted position substantially fully within the door edge, latch operating means in said housing having a longitudinally forward end operably connected to said bolt and longitudinally rearward end operably connected to an actuation means, said actuating means being rotatable about a transverse axis to displace said operating means to reciprocate said bolt, the longitudinal distance between the door edge and said transverse axis of said actuating means constituting backset, the improvement comprising:

plural mutually intersecting cam means within said housing interposed between said actuation means and said latch operation means and operable in rotation within said housing about parallel but offset relative to said door edge transverse axes for alternatively connecting said actuating means with different backset to said operating means and for converting the rotary action of said actuating means to the reciprocating action of said operating means and thereby reciprocate said bolt;

each of said intersecting cam means comprises a disc having opposed protruding cam surfaces;

each of said intersecting cam means further comprising a disc having a spindle slot extending through one edge of said disc;

a first forward cam means having opposed first protruding cam surfaces disposed towards its forward side and a first spindle slot disposed towards its rear side;

a second rear cam means having opposed second protruding cam surfaces disposed towards its forward side and a second spindle slot intersecting said second cam surface;

said first spindle slot on said forward cam intersects and forms an offset continuation of said second spindle slot on said second rear cam;

said protruding cam surfaces on said forward cam means and said protruding cam surfaces on said rear cam means cooperate with a plurality of latch bosses formed on said latch operating means whereby rotation of either am means in either direction retracts said latch operating means; and said latch operating means is interspaced between said cam means and being provided with an elongated slot to permit spindles on said actuating means to pass through and operate said cam means at one of two predetermined backset positions.

* * * * *